United States Patent [19]

Tupper

[11] 4,357,889

[45] Nov. 9, 1982

[54] SAIL HANDLING APPARATUS

[76] Inventor: Alan W. Tupper, The Weavers House, Castle Combe, Wiltshire SN14 7HX, England

[21] Appl. No.: 250,719

[22] Filed: Apr. 3, 1981

[51] Int. Cl.[3] ..... B63H 9/04

[52] U.S. Cl. ..... 114/114; 114/104; 114/111; 114/102; 104/82

[58] Field of Search ..... 114/89, 90, 94, 95, 114/96, 97, 101, 102, 103, 108–115; 104/182

[56] References Cited

U.S. PATENT DOCUMENTS

| | | | |
|---|---|---|---|
| 701,571 | 6/1902 | Keegan | 114/111 |
| 904,119 | 11/1908 | Downs | 104/182 |
| 1,429,007 | 9/1922 | Wilson | 104/182 |
| 4,265,179 | 5/1981 | Tupper | 104/182 |

FOREIGN PATENT DOCUMENTS

| | | | |
|---|---|---|---|
| 14785 | of 1909 | United Kingdom | 114/114 |
| 2024749 | 1/1980 | United Kingdom | 104/182 |

*Primary Examiner*—Trygve M. Blix
*Assistant Examiner*—D. W. Keen
*Attorney, Agent, or Firm*—Scully, Scott, Murphy & Presser

[57] ABSTRACT

Sail handling apparatus comprises an elongate guide element, e.g. a rod or a cable, located along a path along which a tie locating an edge portion of a sail is required to move during sail handling operations. The tie is attached to the guide element by a load-transfer device comprising a pair of rotatable recessed wheels having a guide member located between them at the periphery of the wheels. When the tie is moved along the guide element it can pass intermediate attachment members supporting the guide element with such members being received in the recesses in the wheels which then rotate with respect to the guide element to pass the attachment members through the load-transfer device. In other embodiments, the load-transfer device forms part of the intermediate attachments for the guide element to enable the sail securing ties to pass such attachment points.

10 Claims, 10 Drawing Figures

SAIL HANDLING APPARATUS

FIELD AND BACKGROUND OF THE INVENTION

The invention relates to apparatus for facilitating sail handling operations.

A sail is often located along a mast or boom by sliding elements which are attached along the edge of the sail and which are shaped to engage in a channel formed in the mast or boom. The mast or boom is then made as a hollow usually extruded section shaped to have an open channel along one edge to receive the sliding elements of the sail. However in use the sliding elements can jam in the channel in which they are received to disrupt sail raising and/or lowering. Furthermore a mast and/or boom of a relatively complicated shape is required to receive the sliding elements of the sail.

SUMMARY OF THE INVENTION

According to the invention there is provided apparatus for facilitating sail handling, which apparatus comprises an elongate guide element for location along a path along which a sail securing element is required to move during sail handling operations; and means for enabling a sail securing element to be guided along the elongate element past intermediate support or attachment points for the elongate element, which means includes at least one load-transfer device comprising a rotatable wheel having recesses formed in its periphery at evenly spaced locations therearound and separated by projecting parts of the wheel, and a co-operating guide member supported at a peripheral part of the wheel, and adapted to allow rotation of the wheel with respect to the guide member while locating the elongate element with respect to the wheel whereby a sail securing element located with respect to the elongate element can pass in use intermediate attachment points thereof in recesses of the wheel as it rotates with respect to the guide member. The invention includes an assembly of such apparatus together with one or more sail securing elements as well as such an assembly in combination with a sail to which said sail securing element(s) are attachable to locate an edge portion of the sail for movement along the elongate element.

In some embodiments of the invention the load-transfer device may be engagable with the elongate element for movement therealong whereby a sail securing element can be attached to the load-transfer device for movement therewith along the elongate element during sail handling operations, e.g. where a sail is loose-footed and the rig does not include a boom, and the load-transfer device acting as an attachment for the sail securing element to the elongate element can move past support members for the elongate element with the support member being received, guided and passed in recesses in the wheel of the load-transfer device as the wheel rotates relative to the guide member. A block may be provided on the load-transfer device for connection thereto of the sail securing element.

In other embodiments, apparatus according to the invention can be provided for facilitating raising and lowering sails and may comprise an elongate guide element for location along a mast and/or an associated boom; together with means for supporting the, or a respective, elongate element along the mast and/or boom and said means enabling sail securing elements located in use with respect to the elongate element to slide therealong and past intermediate attachment points for the elongate element. In such embodiments an elongate element for location preferably along the mast and the boom may be a rigid element, e.g. a rod, or tube, but it could instead be a flexible but strong line or cable. In the latter case and where an elongate element is provided along the mast and the boom, the elongate element could be portions of a single elongate element. Further it is also preferred that a load-transfer device as aforesaid is provided at each intermediate attachment point for the elongate element to form a part of the attachment means at such points whereby the said securing elements move along the elongate element and past the attachment points by being received in the recesses in the wheels of the load-transfer devices at the attachment points. In other arrangements it is possible that the load-transfer devices may be associated with the sail securing ties to allow them to move along the elongate element (s) past attachment points therefor. The invention also includes a mast and/or boom assembly fitted with such apparatus.

The load-transfer devices for use in apparatus according to the invention may have many different forms and examples of such devices are described and claimed in my U.S. patent application Ser. No. 021,967, now U.S. Pat. No. 4,265,179, which is incorporated herein by reference.

Embodiments of the invention particularly when used for raising and lowering sails may be particularly applicable to larger ships especially with the prospect of relatively large merchant ships being designed with sail assistance and the possibilities of automation.

DETAILED DESCRIPTION

Figure 1:
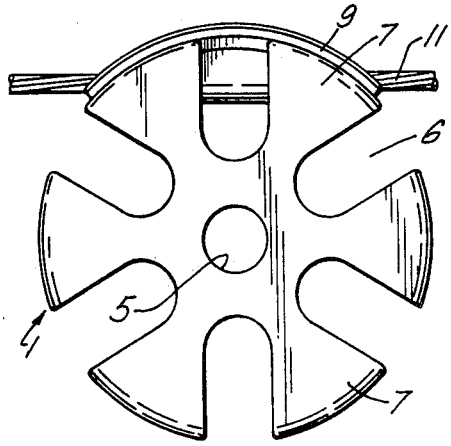
FIGS. 1 to 4 show respectively, a side view, an end view, a plan view and a sectional view of the main components of a load-transfer device for use in apparatus according to the invention.
Figure 2:
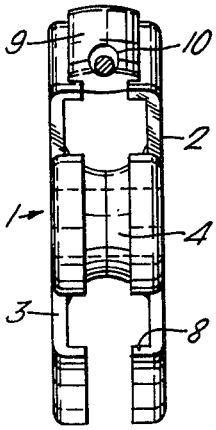
Figure 3:
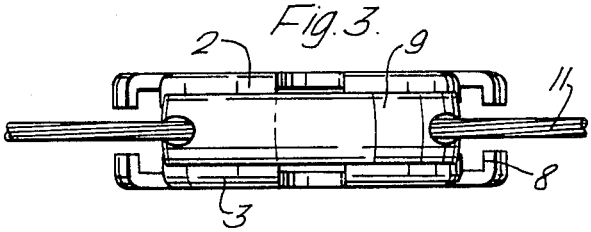
Figure 4:
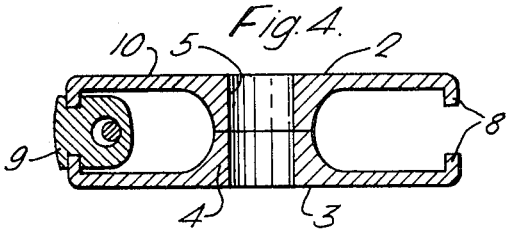

Referring to FIGS. 1 to 4, a load transfer-device comprises a wheel 1 made up of discs 2 and 3 with a central core 4 through which a hole 5 passes. The wheel is mounted by means of an axle through the hole 5 on a support (not shown in FIGS. 1 to 4.) Each disc has six U-shaped recesses 6 and corresponding triangular projecting parts 7 and each projecting part has a flange 8. A wire guide member 9 is grooved to fit flanges 8 as shown and has a longitudinal hole 10 through which a rod, tube, wire or other elongate elements is passed.

Figure 5:
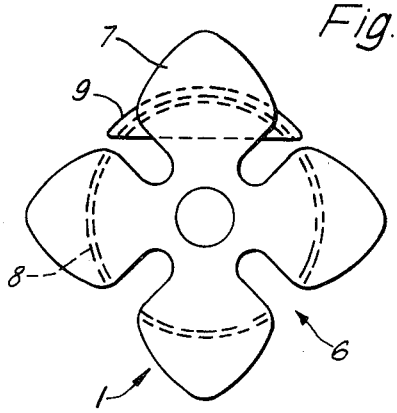
FIG. 5 shows another form of load-transfer device for use in embodiments of the invention.

The number of recesses provided in the wheel may be different in other embodiments depending on factors such as the possible loading on the load-transfer device. One particularly attractive embodiment as shown in FIG. 5 is a four-leaf self-indexing device in which the four projecting parts are rounded and shaped so that the wheel is rotated whenever engaged by a load attachment member whatever the angular position of the wheel. The elongate element is maintained in sliding contact with the guide member 9 and passes in the space defined between the wheels 7, the hub portions of the wheels and the guide member 9.

In yet a further embodiment the leaves of the wheel are replaced by eight tubular projections at the end of which are friction-relieving bearings.

In use, when a sail securing tie which may be hooked onto line 11 slides from right to left (with reference to FIG. 1) along the rod 11 it moves into recess 6 in wheel 1. In doing so it comes into contact with projecting part 7 of the wheel and causes the wheel to rotate in a counter clock-wise direction. As it does so part 7 moves away from the right hand end of guide 9 and the securing tie slides onto guide 9. It is moved over and along the guide, by the pull of the load. When part 7 clears the left hand end of the guide the securing tie moves on to the rod from the guide and the wheel is ready for the next traversing operation.

Figure 7:
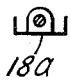
FIGS. 6 and 7 show load-transfer device for use in some embodiments of apparatus according to the invention.
Figure 6:
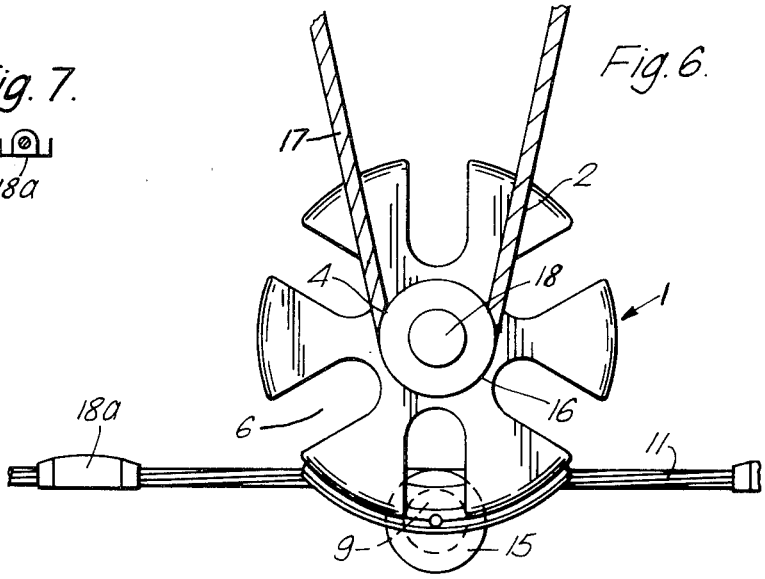

In the embodiment shown in FIGS. 6 and 7 instead of having a load-transfer device at each intermediate support for the rod or wire, such a device can be provided on the end of a sail securing element. This device will traverse simple attachment points 18*a* in a converse manner to that which has been described. An illustration of the principles of such operation is shown in FIG. 7 in which the guide 9 is fitted with a free-running wheel 15 and the device is provided with an associated block 16 to which a sail securing tie 17 is connected. The tie may be connected to the clew of a loose-footed sail so as to deploy the sail and operate it normally.

Figure 8:
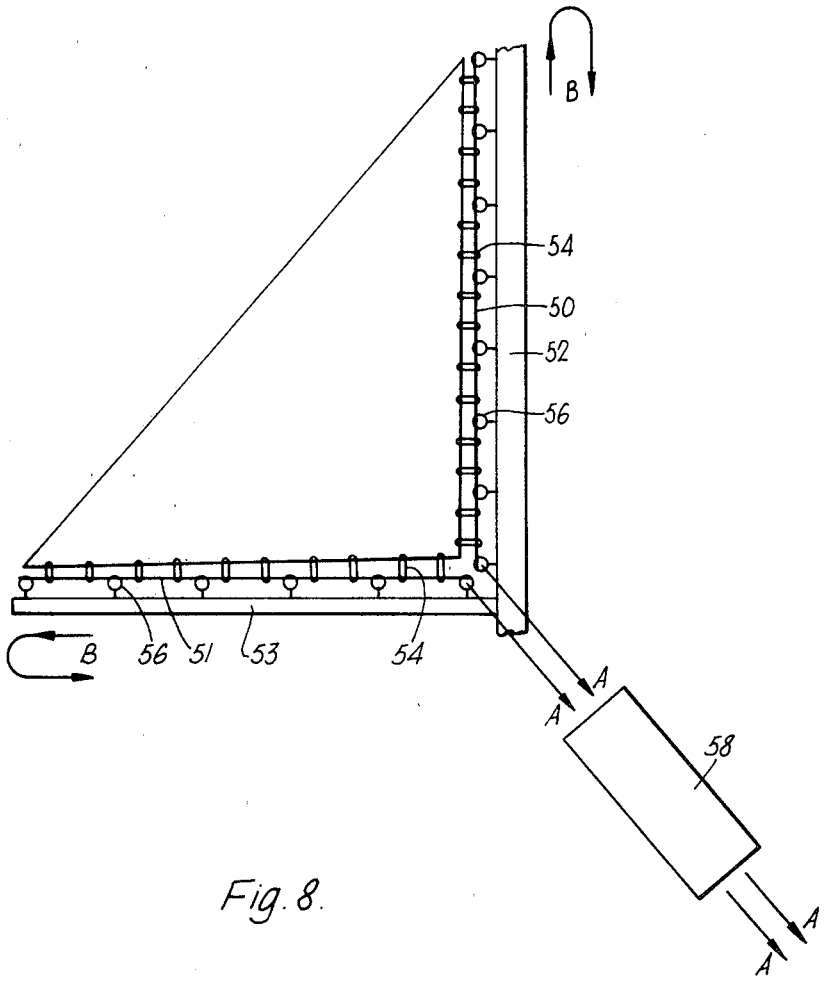
FIG. 8 illustrates diagrammatically apparatus embodying the invention applied to a mast and boom assembly.

FIG. 8 illustrates an embodiment of the invention for facilitating raising and lowering of a sail. In large ships to be assisted by sail, the process lends itself to an automated facility using electric remote-controlled winches. Rods 50,51 are located respectively along the mast 52 and the boom 53 by a series of load-transfer devices 56 such as those illustrated in FIGS. 1 to 6, in such numbers as required to provide sufficient attachment points for such as strength considerations. Sail securing ties 54 provided at spaced locations along the luff and foot of the sail are hooked onto the rods 50,51 and can slide along these rods during raising and lowering of the sail since they can traverse the intermediate attachment points of the rods by movement through the load-transfer devices 56 as described above.

The sail is lowered by applying forces in the two directions in sequence as indicated by arrow A so that the sail can be hauled into a storage container 58. The sail can subsequently be raised by applying forces in the two directions indicated by arrows B. Means for applying these forces could be:

(i) in the case of A, by winding on ropes to which the securing ties 54 are attached. These ropes are brought to the drums of a winch which will be relatively ratioed so that removal of the sail foot and luff from boom and mast are matched;

(ii) in the case of B, the outhaul of the sail is provided in an opposite direction through the same ropes to which securing ties 54 are attached by the use of turning blocks at the boom and mast ends. The same winch drums can be used so that the deployment of the sail foot and luff are matched.

Figure 9:
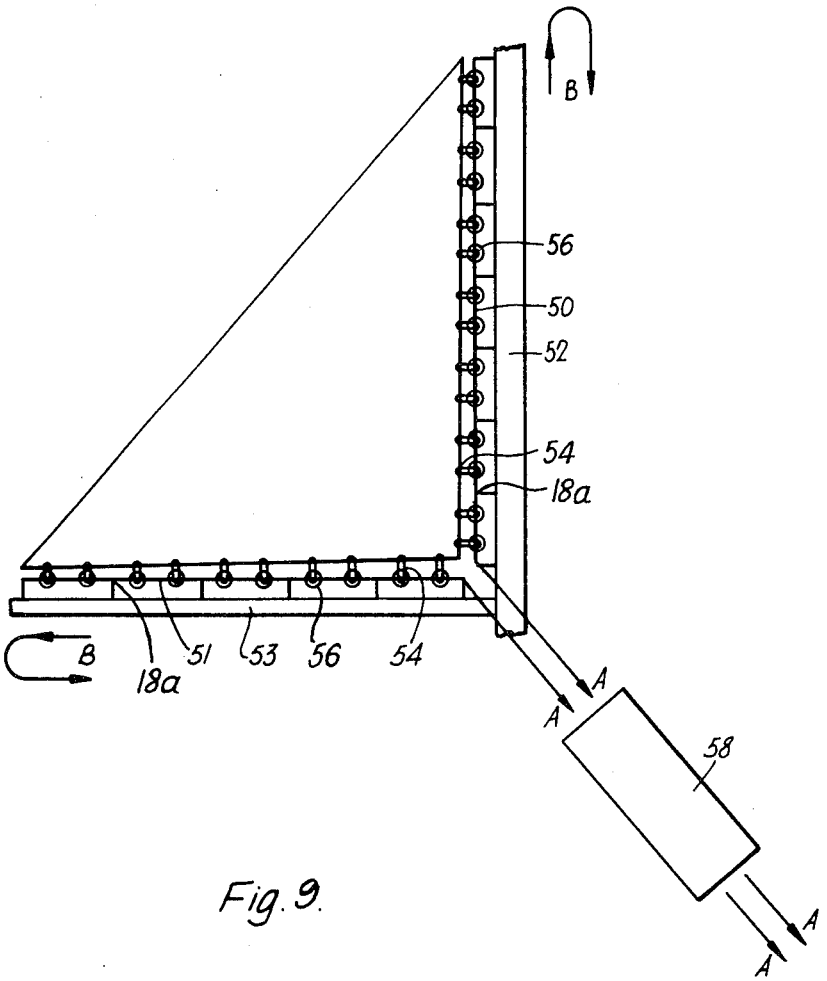
FIG. 9 illustrates diagrammatically a modification of the apparatus shown in FIG. 8.

In other embodiments, a load-transfer device may be attached to the sail securing ties (e.g. as shown in FIG. 6) and engaged with the rods located along the mast and the boom to allow the ties to move along the rods past attachment points therefor, as shown diagrammatically in FIG. 9.

Figure 10:
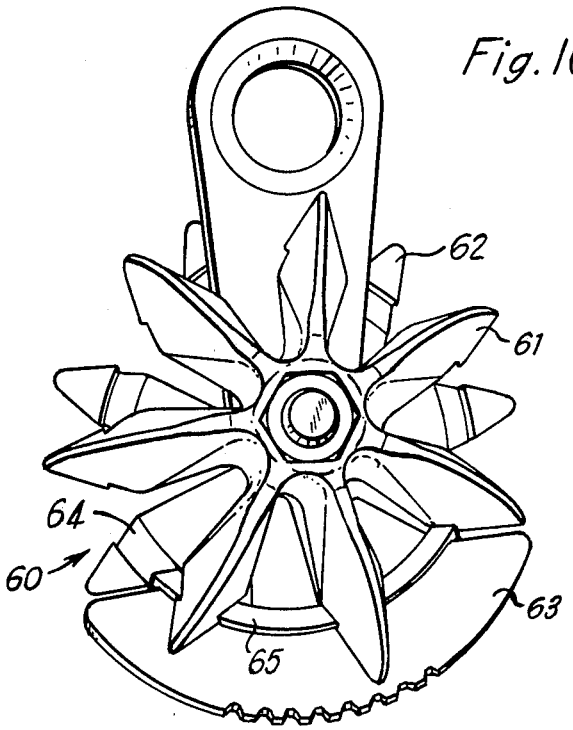
FIG. 10 is a perspective view of a further load-transfer device.

FIG. 10 shows a further load-transfer device 60 for use in the above described sail handling systems. The device comprises two wheels 61,62 which are generally dome-shaped and have seven radially projecting parts defining therebetween seven equi-angularly spaced recesses. The outer form of each wheel although generally hemispherical has a relatively flat central area at the top of the dome. This construction provides added strength particularly behind the grooves 64 in the wheels. The slug member 63 has arcuate flanges 65 which engage in the grooves 64 in the wheels respectively.

What is claimed is:

1. Sail handling apparatus comprising:

a. an elongate element extending along a boom and/or a mast;

b. support means to fixedly locate the elongate element to the boom and/or mast at the ends of the elongate element and at a plurality of intermediate positions spaced along the length of the elongate element to hold the elongate element firmly in position along the boom and/or mast in a generally parallel spaced apart relation thereto;

c. a sail having a plurality of traversing devices fixed at spaced locations along at least one edge thereof to cooperate with the elongate element for moving past said support means at least at said intermediate positions, each traversing device comprising:

i. at least one rotatable wheel formed with evenly spaced recesses in its periphery, the recesses being separated by respective projecting parts of the wheel;

ii. a guide member which is supported at a peripheral part of the wheel and is located between the elongate element and the associated boom or mast for sliding movement along the elongate element, the projecting parts of the wheel and the guide member having cooperating relatively rotatable surfaces to allow the wheel to rotate about its axis with respect to the guide member when said support means are received in a recess in the wheel and while the elongate element remains located with respect to the wheel by the guide member; and d. means for moving the traversing devices in both directions along the elongate element to deploy the sail therealong and to gather in the sail, respectively.

2. Sail handling apparatus comprising:

a. an elongate element extending along a boom and/or a mast;

b. a sail having along at least one edge thereof a plurality of spaced apart sail securing ties engaged around the elongate element for sliding movement along the elongate element;

c. support means to fixedly locate the elongate element to the boom and/or mast at the ends of said elongate element and at a plurality of intermediate points spaced along the length of the elongate element with the elongate element in a generally parallel spaced apart relation to the boom and/or mast, said support means comprising at least at said intermediate points:

i. at least one rotatable wheel formed with evenly spaced recesses in its periphery, the recesses being separated by respective projecting parts of the wheel;

ii. a guide member supported at a peripheral part of the wheel and engaged with the elongate element, the projecting parts of the wheel and the guide member having cooperating relatively rotatable surfaces to allow the wheel to rotate about its axis with respect to the guide member when a sail securing tie engages in a recess in the wheel while the elongate element remains located with respect to the wheel by the guide member whereby the sail securing ties can traverse the support means for the elongate element at said intermediate points; and d. means for moving the sail securing ties in both directions along the elongate element to deploy the sail therealong and to gather in the sail, respectively.

3. Sail handling apparatus according to claim 1 or claim 2, wherein the elongate element is a rigid element.

4. Sail handling apparatus according to claim 1 or claim 2, wherein the elongate element extends along the mast and the boom and is provided by portions of a single flexible line.

5. Sail handling apparatus comprising:

a. a loose-footed sail having an unsecured corner;

b. an elongate element extending along a path of movement of said corner of the sail;

c. support means to fixedly locate the elongate element to a fixed structure of a vessel at the ends of the elongate element and at a plurality of intermediate positions spaced along the length of the elongate element to hold the elongate element firmly in position along said fixed structure in a spaced apart relation thereto;

d. a sail locating tie associated with said unsecured corner of the sail; and e. a traversing device for the sail locating tie, which device comprises:

i. at least one rotatable wheel formed with evenly spaced recesses in its periphery, the recesses being separated by respective projecting parts of the wheel;

ii. a guide member support at a peripheral part of the wheel and engaged with the elongate element, the projecting parts of the wheel and the guide member having cooperating relatively rotatable surfaces to allow the wheel to rotate about its axis with respect to the guide member when said support means at said intermediate locations are received in a recess in the wheel and while the elongate element remains located with respect to the wheel by the guide member, and f. a block provided on the traversing device for engagement by said sail locating tie whereby said unsecured corner is located for free movement along the path defined by the elongate element freely past said support means at said intermediate support positions.

6. Sail handling apparatus according to claim 1 or claim 2 or claim 5, wherein the traversing device comprises a pair of spaced wheels, each being dome-shaped, and the guide member is positioned in the space between the wheels.

7. Sail handling apparatus comprising:

a. an elongate element extending along a boom and a mast;

b. support means to fixedly locate the elongate element to the boom and mast at the ends of the elongate element and at a plurality of intermediate positions spaced along the length of the elongate element to hold the elongate element firmly in position along the boom and mast in a generally parallel spaced apart relation thereto;

c. a sail having a plurality of traversing devices fixed at spaced locations along at least one edge thereof to cooperate with the elongate element for movement past said support means at least at said intermediate positions, each traversing device comprising:

i. at least one rotatable wheel formed with evenly spaced recesses in its periphery, the recesses being separated by respective projecting parts of the wheel;

ii. a guide member which is supported at a peripheral part of the wheel and is located between the elongate element and the associated boom or mast for sliding movement along the elongate element, the projecting parts of the wheel and the guide member having cooperating relatively rotatable surfaces to allow the wheel to rotate about its axis with respect to the guide member when said support means are received in a recess in the wheel and while the elongate element remains located with respect to the wheel by the guide member;

d. lines interconnecting the traversing devices along the boom and the mast, respectively, e. means to draw said lines in one direction along the elongate elements to deploy the sail along the boom and mast and in the opposite direction along the elongate elements to gather in the sail, and f. a storage container for the sail, said lines extending through the storage container to draw the sail into said container when it is gathered in as aforesaid.

8. Sail handling apparatus comprising:

a. an elongate element extending along a boom and a mast;

b. a sail having along at least one edge thereof a plurality of spaced apart said securing ties engaged for sliding movement along the elongate element;

c. support means to fixedly locate the elongate element to the boom and mast at the ends of said elongate element and at the elongate element with the elongate element in a generally parallel spaced apart relation to the boom and mast, said support means comprising at least at said intermediate points;

i. at least one rotatable wheel formed with evenly spaced recesses in its periphery, the recesses being separated by respective projecting parts of the wheel;

ii. a guide member supported at a peripheral part of the wheel and engaged with the elongate element, the projecting parts of the wheel and the guide member having cooperating relatively rotatable surfaces to allow the wheel to rotate about its axis with respect to the guide member when a sail securing tie engages in a recess in the wheel while the elongate element remains located with respect to the wheel by the guide member whereby the sail securing ties can traverse the support means for the elongate element at said intermediate points;

d. lines interconnecting the sail securing ties along the boom and the mast, respectively, e. means to draw said lines in one direction along the elongate elements to deploy the sail along the boom and the mast, and in the opposite direction along the boom and the mast to gather in the sail, and f. a storage container for the sail, said lines extending through said container to draw the sail into said container when it is gather in as aforesaid.

9. Sail handling apparatus according to claim 7 or claim 8, wherein said means for drawing said lines comprise a winch drum for each of said lines, turning blocks at the free end of the boom and the mast, respectively, around which said lines extend to return along the boom and the mast, respectively, to said winch drums, the peripheral speeds of the winch drums being matched to provide substantially even deployment of the sail along the mast and the boom and substantially even gathering in of the sail along the mast and the boom.

10. Sail handling apparatus according to claim 1 or claim 7, wherein said traversing devices are associated with sail securing ties fixed at spaced locations along at least one edge of the sail.

* * * * *